United States Patent [19]

Spieldiener et al.

[11] Patent Number: 4,696,251

[45] Date of Patent: Sep. 29, 1987

[54] RAPID RIVER RIDE BOAT

[76] Inventors: Robert Spieldiener, IM Winkel 13, FL-9496 Balzers, Liechtenstein; Reinhold Spieldiener, Aussichtsstrasse 23, 8704 Herrliberg; Alfons Saiko, Speerstrasse 26A, Oberrieden, both of Switzerland

[21] Appl. No.: 882,505

[22] Filed: Jul. 7, 1986

Related U.S. Application Data

[63] Continuation of Ser. No. 585,124, Mar. 1, 1984, abandoned.

[51] Int. Cl.[4] ..... B63B 3/00

[52] U.S. Cl. ..... 114/346; 114/345; 114/363

[58] Field of Search ..... 114/346, 345, 363, 361, 114/362; D12/316; D21/249, 250; 441/40; 272/32, 1 B

[56] References Cited

U.S. PATENT DOCUMENTS

| | | | |
|---|---|---|---|
| D. 269,082 | 5/1983 | Spieldiener | D12/316 |
| 1,378,273 | 5/1921 | Picco . | |
| 2,343,313 | 3/1944 | Maynes | 114/346 |
| 3,335,436 | 8/1967 | Sharp | 114/346 |

FOREIGN PATENT DOCUMENTS

| | | |
|---|---|---|
| 3246425 | 6/1984 | Fed. Rep. of Germany . |
| 58-63588 | 7/1983 | Japan . |

*Primary Examiner*—Joseph F. Peters, Jr.
*Assistant Examiner*—Edwin L. Swinehart
*Attorney, Agent, or Firm*—Bielen and Peterson

[57] ABSTRACT

A circular floatation vehicle, particularly for rafting as an amusement ride, the vehicle having an annular tube with a circular platform inset, wherein the platform inset is constructed with a central contoured core to seat a plurality of occupants around the core, whereby the core provides a common back rest and seat, allowing the occupants to be seated around the core facing outward from the center of the floatation vehicle for improved visibility and safety.

5 Claims, 4 Drawing Figures

RAPID RIVER RIDE BOAT

This is a continuation of application Ser. No. 585,124 filed Mar. 1, 1984, now abandoned.

BACKGROUND OF THE INVENTION

This invention relates to a recreational raft, particularly to a floatation vehicle suitable for an amusement ride. The floatation vehicle of this invention is similar in use to the vehicle described in the application "Amusement Ride Loading Terminal", Ser. No. 473,812, Filed Mar. 9, 1983, now U.S. Pat. No. 4,543,886. However, certain significant improvements have been made which affect both the enjoyment of the ride and the safety of the amusement raft therein described.

In the amusement raft previously described, an annular bladder supports a center shell having seats peripherally spaced around the outer rim of the shell. In this configuration occupants are seated around the raft in a manner that they all faced toward the center. While this arrangement has certain advantages in maximizing the seating capacity and enhancing passenger communication, it has been found that significant disadvantages exist in the operation of this amusement raft. Because the raft is designed primarily for amusement and not for sport, the raft must be designed to be as safe as possible. With passengers facing inward, an abrupt impact of the vehicle against a object in the water course, could cause the unwary occupant, whose back was to the object, to fall out of the raft, or, suffer an injury to the back or to the head. The stability of the vehicle is also diminished. By the weight being distributed around the periphery of the raft, sudden shifts in distribution of the weight may cause excessive tipping.

Additionally, the enjoyment of the ride is somewhat diminished by the inability of the occupants to directly see outward from the vehicle, or react immediately to a preceived threat of danger, whether real of imaginary.

These disadvantages in the existing design of the raft have been avoided by the improved design of the circular amusement raft that includes additional desirable features as described hereafter.

SUMMARY OF THE INVENTION

The floatation vehicle of this invention comprises a circular amusement raft with an outer annular tube, preferably a deformable, air-filled bladder and an inner circular inset platform. The inset platform has a contoured seating core constructed to seat a plurality of occupants with their backs to a raised central hub and their feet positioned around an outer rim.

This seating arrangement provides certain distinct advantages. Occupants look outward from a central position, greatly enhancing their field of vision and preparation for vehicle impact with objects in the water course. The central seating arrangement distributes a major portion of the passenger weight at the center of the vehicle. This stabilizes the vehicle, particularly where the vehicle is not fully occupied, yet makes the vehicle more responsive to waves and rotational forces which impart a spin to the vehicles, an important aspect of the amusement ride.

The reduction of angular inertia is also of importance during the run through the course, where friction of boats touching the sides of the river causes tangential forces to deliberately provide added spin to enhance the ride's excitement. These and other features will become apparent from a consideration of the detailed description of the preferred embodiment.

DETAILED DESCRIPTION OF THE PREFERRED EMBODIMENT

Figure 1:
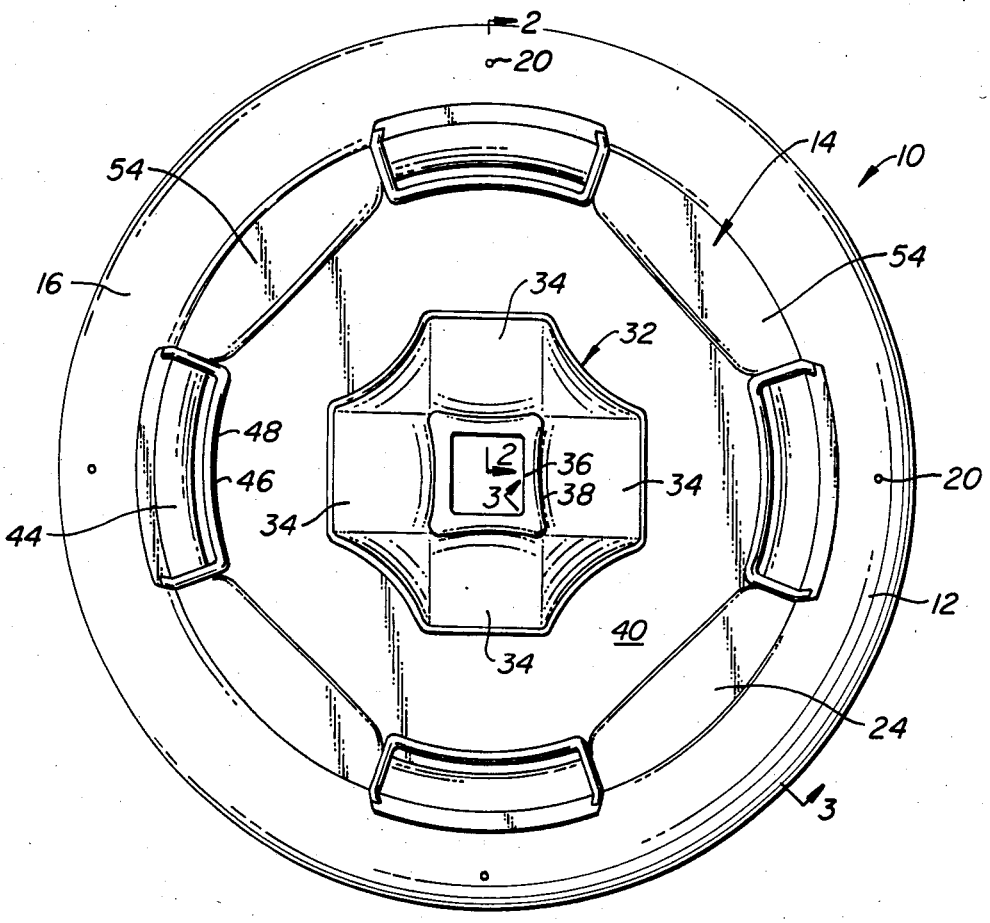
FIG. 1 is a top view of the floatation vehicle of this invention.

Referring to FIG. 1 the top view of the floatation vehicle of this invention, designated generally by the reference numeral 10, illustrates the central seating concepts of this invention, as applied to an amusement raft designed for four passengers. It is understood that equivalent vehicles of different seating capacity or of different arrangement within the scope of this invention can be fabricated by those skilled in the art.

The preferred embodiment of the floatation vehicle 10 is constructed with an outer annular float 12 and an inner circular inset 14. The annular float 12 may be fabricated from an air filled rubber of special shape. The annulus 16 has abrasion resistent surface, with protective wear strips 18 fastened to the outer surface of the annulus to guard against scrapes. The annulus may be foam filled or air filled, as shown with air valves 20 positioned around the annulus.

The circular inset 14 combines two primary components, a circular floatation platform 22 and a contoured passenger shell 24. The floatation platform 22 is constructed with a water impervious foam disk 26 that has a fiberglass covering 28 and a fiberglass rim 30 or a rim fabricated from other adequate structural material.

Figure 2:
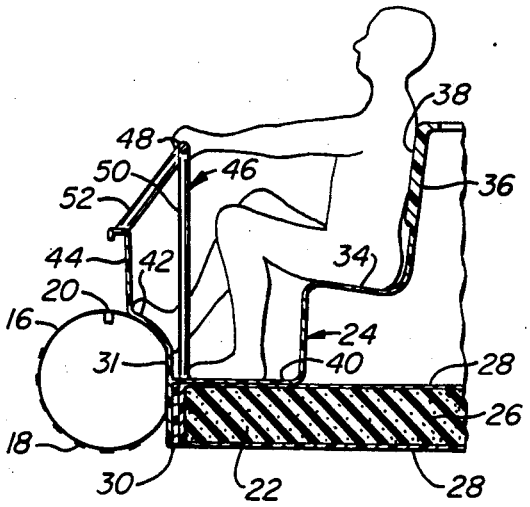
FIG. 2 is a cross sectional view taken on the lines 2—2 in FIG. 1.

The passenger shell 24 is preferably fabricated from a single formed synthetic, such as fiberglass to minimize water leakage and to maximize strength. A special novelty feature is the friction connection of the float annulus to the fiberglass rim 30 of the float platform. The bouncing of the vehicle in the water in waves causes considerable forces between the air inflated circular float and the inner circular inset. To cause better adherence between inflated rubber tube and circular inset, the inside of the otherwise circular cross section of the rubber tube has a flattened portion 60 as shown in FIG. 2.

This flattened inside portion 60 of the tube causes increased forces applied against the surface of saddle 61, in turn causing a better friction connection between the circular floating tube and the fiberglass body 31 of the circular inset.

Figure 4:
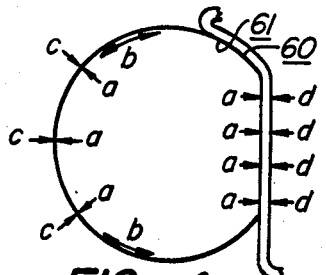
FIG. 4 is a schematic view of a partial section of the floatation vehicle.

In a circular tube, air pressure inside causes equally spaced forces all around towards the outside, FIG. 4 forces "a". These forces are counteracted by the elastic stretch of the inflated rubber, the tangential forces "b". Such produce in turn, the counteracting radial forces "c". All these forces occur uniformly all around the tube circumference in a normal underformed annulus.

With the tube flattened around the inside, the air pressure produces the outward acting forces "a" all around. The flattened portion of the rubber, however, cannot produce the tangential forces of the stretched rubber of a pure circular configuration. The counteracting forces "c" are therefore not produced within the rubber wall and the forces "a", will tend to bulge the flattened surface outward to produce the balanced circular shape again. At this point, however, the flat rubber portion is pressed against the equally flat fiberglass saddle and the fiberglass restraint produces the counteracting forced "d". The balancing force is therefore created at the contact of the rubber and fiberglass surface of the rim 30 of the float platform. This results in a greater friction force between rubber and fiberglass resulting in a better friction connection between the inflated rubber tube and circular inset.

The passenger shell 24 has a central seating core 32 with four contoured seats 34 and a raised center hub 36 with four contoured padded back rests 38. The seating core may easily be designed for six eight or any number of passengers by altering the polygon configuration or by use of circular back rest and concentric seat bench.

As shown in the cross sectional view of FIG. 2, a passenger, shown in phantom, is comfortably seated on the seating core with his feet on the floor 40 of the shell, or on a contoured segment 42 of rim 30 which abuts the annular float 12. For safety and for the purpose of providing a splashguard, the rim segment 42 in front of the passenger has a raised section 44.

Figure 3:
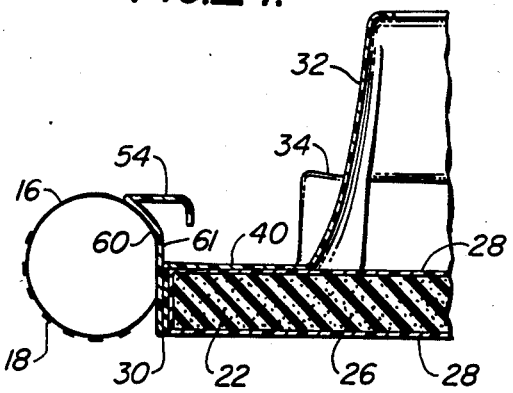
FIG. 3 is a cross sectional view taken on the lines 3—3 in FIG. 1.

A hand rail 46 disposed in front of the passenger has a horizontal hand segment 48 supported by two vertical posts 30 and two reinforcement struts 52 connected to the raised section 44 of the rim. Referring to the cross sectional view of FIG. 3, the section of the passenger shell between adjacent seats is shown to include a step 54 to assist in boarding or departing the vehicle. The splashguard and rail are eliminated in these sections in the preferred embodiment for simplicity. However, in other embodiments a folding splashguard and/or a guard rail can be installed to allow access and provide an added degree of safety.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A circular flotation vehicle constructed to uniformly seat a plurality of passengers for an amusement ride, comprising:

an annular deformable float and an inner substantially rigid inset with a circular flotation platform and a coupled passenger shell, the passenger shell having a central core with a plurality of integral fixed seats uniformly arranged in a single concentric course around the periphery of the core and with a raised center structure forming backrests for said seats, said substantially rigid inset being constructed with a concentric floor and a raised contoured outer rim which abuts the annular float, said inset being arranged to seat a plurality of passengers around the central core with the passengers'feet positioned on the floor or outer rim and the passengers' backs positioned against the raised structure of the core wherein the passengers face outward for improved visibility, safety and centralized location of aggregate passenger weight and wherein the outer rim of the inset has a raised splashguard portion in front of the seats and a low entry portion between the splashguard portions.

2. The circular floatation vehicle of claim 1 wherein the circular floatation platform has a periphery which is functionally engaged by the deformable float.

3. The circular floatation vehicle of claim 1 wherein the annular float is an air inflated tube.

4. The circular floatation vehicle of claim 1 wherein the inset has at least one step in said low entry portion of the rim for convenient entry and egress.

5. The circular floatation vehicle of claim 1 wherein the inset includes guard rails disposed in front of the passenger seats.

* * * * *